US006996954B1

(12) United States Patent
Farley et al.

(10) Patent No.: US 6,996,954 B1
(45) Date of Patent: Feb. 14, 2006

(54) HORIZONTAL SLEEVE APPLICATOR AND METHOD

(75) Inventors: Edward W. Farley, Raleigh, NC (US); Kuo-Raid Grant Chen, Cary, NC (US); David A. Felix, Clayton, NC (US); Gordon L. Gregory, Garner, NC (US); Randolph S. Victor, Cary, NC (US)

(73) Assignee: Axon Corporation, Raleigh, NC (US)

( * ) Notice: Subject to any disclaimer, the term of this patent is extended or adjusted under 35 U.S.C. 154(b) by 157 days.

(21) Appl. No.: 10/739,628

(22) Filed: Dec. 18, 2003

(51) Int. Cl.
*B65B 9/00* (2006.01)

(52) U.S. Cl. ..... 53/459; 53/557; 53/567; 53/585; 493/273; 493/288

(58) Field of Classification Search ..... 53/399, 53/397, 442, 450, 452, 455, 457, 459, 461, 53/463, 558, 570, 576, 582, 585, 589, 590, 53/593
See application file for complete search history.

(56) References Cited

U.S. PATENT DOCUMENTS

| | | | | | |
|---|---|---|---|---|---|
| 3,799,834 | A | * | 3/1974 | Horvath | 156/481 |
| 3,802,152 | A | | 4/1974 | Strub | |
| 3,910,013 | A | * | 10/1975 | Babineau | 53/291 |
| 4,179,863 | A | * | 12/1979 | Fresnel | 53/295 |
| 4,208,857 | A | * | 6/1980 | Fujio | 53/585 |
| 4,387,553 | A | | 6/1983 | Strub et al. | |
| 4,497,156 | A | * | 2/1985 | Scheidegger | 53/399 |
| 4,545,181 | A | * | 10/1985 | Frankefort | 53/459 |
| 4,765,121 | A | * | 8/1988 | Konstantin et al. | 53/442 |
| 4,806,187 | A | * | 2/1989 | Fujisawa | 156/86 |
| 4,914,893 | A | | 4/1990 | Strub et al. | |
| 5,006,196 | A | | 4/1991 | Vandevoorde | |
| 5,024,049 | A | | 6/1991 | Strub et al. | |
| 5,060,367 | A | | 10/1991 | Vandevoorde | |
| 5,086,682 | A | | 2/1992 | Strub et al. | |
| 5,305,578 | A | | 4/1994 | Menayan | |
| 5,433,057 | A | | 7/1995 | Lerner et al. | |
| 5,483,783 | A | | 1/1996 | Lerner et al. | |
| 5,495,704 | A | | 3/1996 | Menayan | |
| 5,711,135 | A | | 1/1998 | Menayan | |
| 5,715,651 | A | | 2/1998 | Thebault | |
| 5,759,337 | A | | 6/1998 | Fujio et al. | |
| 6,263,940 | B1 | | 7/2001 | Menayan | |
| 6,474,390 | B1 | | 11/2002 | Vandevoorde | |
| 6,523,331 | B1 | * | 2/2003 | Fresnel | 53/557 |
| 6,543,514 | B1 | | 4/2003 | Menayan | |
| 6,684,599 | B1 | * | 2/2004 | Fresnel | 53/64 |

* cited by examiner

*Primary Examiner*—Rinaldi I. Rada
*Assistant Examiner*—Thanh Truong
(74) *Attorney, Agent, or Firm*—Michael R. Philips

(57) ABSTRACT

An apparatus and method are provided for enwrapping a horizontally oriented product in a sleeve. A sleeve is formed by opening a flat tubular film and cutting a selected length of tubing. The sleeve is further opened in a forming tube to a cross sectional shape comparable with the cross sectional shape of the product. The forming tube is moved from a receiving position to a discharge position and the sleeve is moved in a horizontal plane to enclose the axially aligned product carried on a horizontally oriented conveyor.

20 Claims, 5 Drawing Sheets

HORIZONTAL SLEEVE APPLICATOR AND METHOD

FIELD OF THE INVENTION

The present invention relates to the field of apparatus and methods for the application of tubular labels to products, and more particularly to such apparatus and methods adapted for use with the products in horizontal orientation.

BACKGROUND OF THE INVENTION

Tubular film 12 is drawn from a supply (see FIG. 2, number 40) in the direction indicated by arrow A, i.e. downstream, to pass a cutter 14, of any known type selected according to the shear characteristics of the tubular film 12 material. Tubular film 12 is an extruded plastic resin, for example polyvinyl chloride (PVC) or high density polyethylene (HDPE). In the preferred embodiment, a cutter 14 comprises a fixed blade and a movable blade. The movable blade is moved along a linear path that is perpendicular to planes α and β, and the fixed blade resides at a slight angle to the moving blade. A cutter of this type is described in detail in U.S. patent application Ser. No. 10/411,717, owned by the assignee of this application, and incorporated herein by reference. Other forms of cutter, for example a single blade cutter or a hot wire cutter, are considered within the scope of the present invention.

As tubular film 12 is moved forward in the direction of arrow A, a forward portion of tubular film 12 is inserted into forming tube 18*a* for a selected length beyond cutter 14. Cutter 14 then severs the selected length of tubular film 12 from the supply of tubular film, creating sleeve 22. The selected length of sleeve 22 is typically chosen to substantially equal the length of product 24 to be enwrapped thereby. In other applications, the length of sleeve 22 is selected to be shorter than the length of product 24 so as to enwrap a portion, not the entire length, of product 24. When sleeve 22 has been severed from the supply of tubular film 12, forming tube 18*a* is moved downwardly to its second position at plane β with sleeve 22 residing therein, placing forming tube 18*b* in axial alignment with product 24. Product 24 is resting upon support links 28 of conveyor 26. Product 24 is conveyed upon conveyor 26 in the direction indicated by arrow D. As shown, product 24 is relatively long and thin, for example a felt tip pen, and is best handled in horizontal orientation. Support links 28 are preferably formed with a tapered end 29, residing closer to forming tube 18*b* so as to reduce resistance to the assembly of sleeve 22 onto product 24. It is to be understood that the stiffness and frictional characteristics of sleeve 24 affect the ease of assembly. When described below without regard to being at a level with either plane α or plane β in the apparatus, the forming tube will be designated as forming tube 18. In the preferred embodiment of the invention, support links 28 are manifested as rotatable rollers so that product 24 and sleeve 22 can be rotated in a downstream heat tunnel to uniformly shrink sleeve 22 to snugly enwrap and conform to the contours of product 24. In other embodiments not incorporating a sleeve-shrinking station, support links 28 may be fixed rather than rotatable. Whereas forming tube 18 of the preferred embodiment is moved vertically from a first position that is high to a second position that is low, it is understood that different transitional directions, for example from left to right, would be modifications within the scope of the present invention.

Vertical sleeve handling often involves a tubular machine component into which the cut sleeve is placed prior to discharging onto the product being labeled. A drawback of vertical sleeve handling is that the cut sleeve will fall through the tube unless the tube is matched closely enough to the size of the sleeve to be held in place by friction, or a holding device, e.g. a suction port, is provided. Since the extruded tubular sleeve will vary somewhat from one lot to the next, the vertical holding tube needs to be changed to accommodate the desired tight fit.

The present invention, as will be described below, provides a sleeve applicator that maintains the product and the tubular sleeve in horizontal orientation. Horizontal orientation allows a variation of sleeve diameter without generally requiring a change of sleeve holding tube. A known horizontal sleeve applicator is manufactured by Marburg Industries, Inc. of Vista, Calif.

SUMMARY OF THE INVENTION

The horizontal sleeve applicator described herein is configured to draw a length of flat tubing from a supply of tubular film and to open the flat tubing to a round configuration by use of an internal spreader and an external forming tube aligned with the supply. The opened sleeve is cut from the supply with a selected length positioned in the forming tube. The forming tube is next moved from its first position in alignment with the supply to a second position in alignment with a product to be enwrapped. The sleeve is next discharged from the forming tube onto the product. The sleeve is subsequently shrunk to snugly fit the product.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
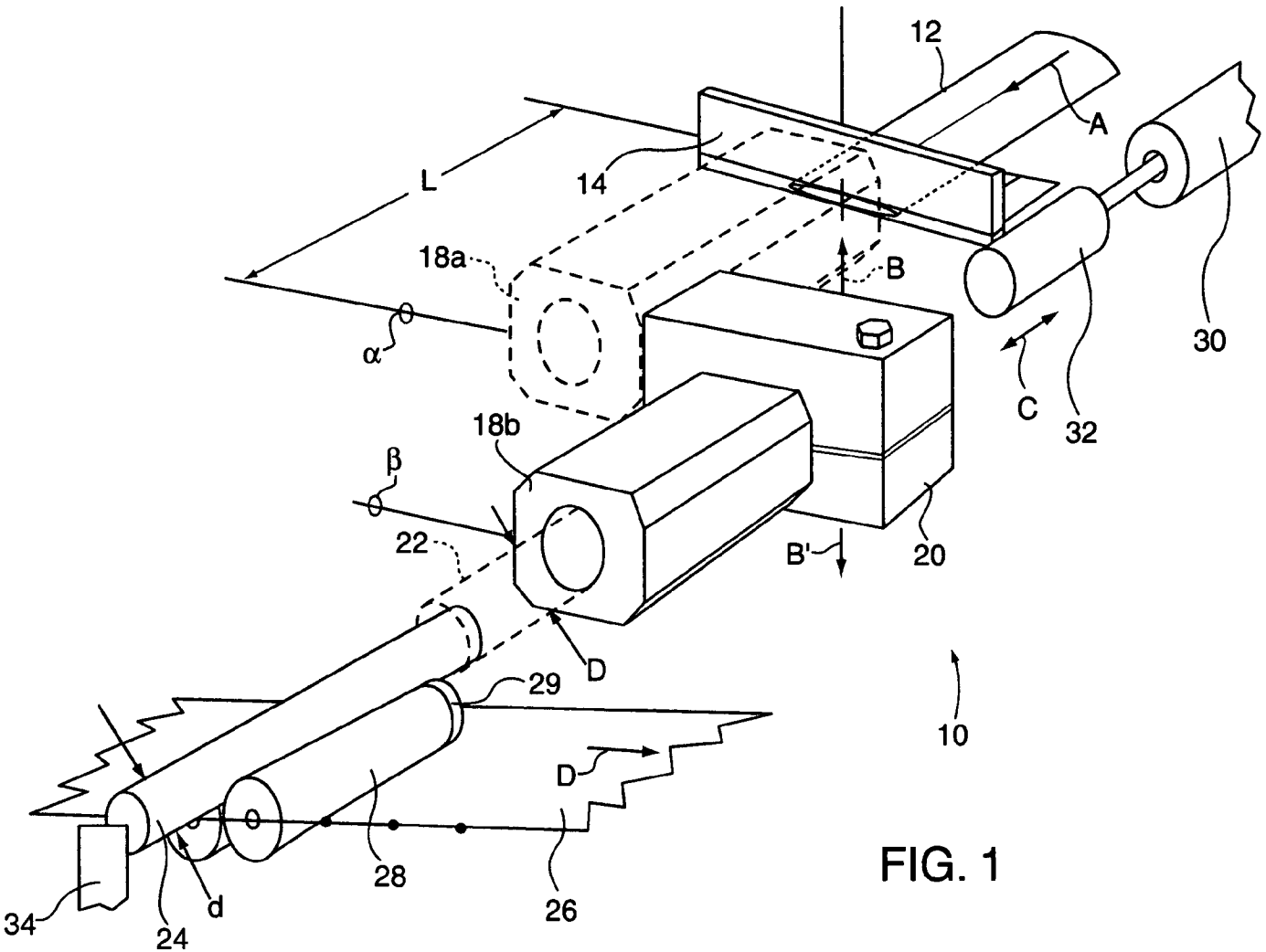
FIG. 1 is a perspective schematic view of the operational components of the horizontal sleeve applicator, and the forming tube is shown in its first and second positions, with the forming tube in its first position shown in dashed lines for clarity.

The horizontal sleeve applicator 10 of the present invention, illustrated schematically in FIG. 1, is operative by moving a forming tube 18 between two horizontal, spaced apart, planes, noted α and β, respectively. Plane α indicates the horizontal level at which tubular film 12 is supplied into forming tube 18 of the invention apparatus, and plane β indicates the horizontal level at which the tubular film 12, now cut to a selected length to form a sleeve 22, is discharged from forming tube 18 and applied onto a product 24. The traverse of sleeve 22 from plane α to plane β is effected by a reciprocating vertical movement of forming tube 18 from its first position 18*a* (shown in dashed lines) to its second position 18*b*, while sleeve 22 resides therewithin.

Tubular film 12 is drawn from a supply (not shown in this drawing) in the direction indicated by arrow A, i.e. downstream, to pass a cutter 14, of any known type selected according to the shear characteristics of the tubular film 12 material. Tubular film 12 is an extruded plastic resin, for example polyvinyl chloride (PVC) or high density polyethylene (HDPE). In the preferred embodiment, a cutter 14 comprises a fixed blade and a movable blade. The movable blade is moved along a linear path that is perpendicular to planes α and β, and the fixed blade resides at a slight angle to the moving blade. A cutter of this type is described in detail in U.S. patent application Ser. No. 10/411,717, owned by the assignee of this application, and incorporated herein by reference. Other forms of cutter, for example a single blade cutter or a hot wire cutter, are considered within the scope of the present invention.

As tubular film 12 is moved forward in the direction of arrow A, a forward portion of tubular film 12 is inserted into forming tube 18*a* for a selected length beyond cutter 14. Cutter 14 then severs the selected length of tubular film 12 from the supply of tubular film, creating sleeve 22. The selected length of sleeve 22 is typically chosen to substantially equal the length of product 24 to be enwrapped thereby. In other applications, the length of sleeve 22 is selected to be shorter than the length of product 24 so as to enwrap a portion, not the entire length, of product 24. When sleeve 22 is severed from the supply of tubular film 12, forming tube 18*a* is moved downwardly to its second position at plane β with sleeve 22 residing therein, placing forming tube 18*b* in axial alignment with product 24. Product 24 is resting upon support links 28 of conveyor 26. Product 24 is conveyed upon conveyor 26 in the direction indicated by arrow D. As shown, product 24 is relatively long and thin, for example a felt tip pen, and is best handled in horizontal orientation. Support links 28 are preferably formed with a tapered end 29, residing closer to forming tube 18*b* so as to reduce resistance to the assembly of sleeve 22 onto product 24. It is to be understood that the stiffness and frictional characteristics of sleeve 24 affect the ease of assembly. When described below without regard to being at a level with either plane α or plane β in the apparatus, the forming tube will be designated as forming tube 18. In the preferred embodiment of the invention, support links 28 are manifested as rotatable rollers so that product 24 and sleeve 22 can be rotated in a downstream heat tunnel to uniformly shrink sleeve 22 to snugly enwrap and conform to the contours of product 24. In other embodiments not incorporating a sleeve-shrinking station, support links 28 may be fixed rather than rotatable. Whereas forming tube 18 of the preferred embodiment is moved vertically from a first position that is high to a second position that is low, it is understood that different transitional directions, for example from left to right, would be modifications within the scope of the present invention.

Figure 2:
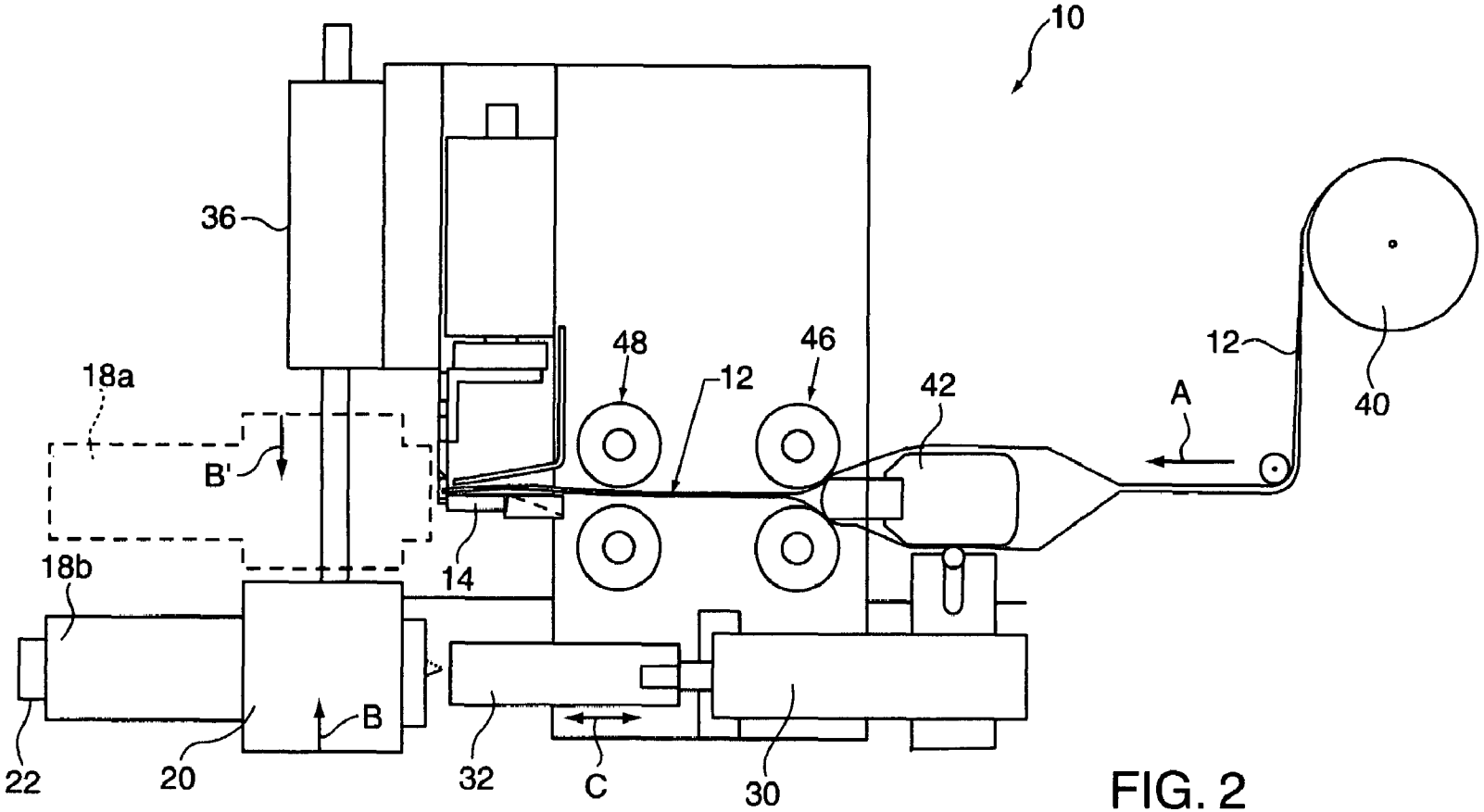
FIG. 2 is a side elevation view of the horizontal sleeve applicator of the invention, without the product-supplying conveyor apparatus.
Figure 3:
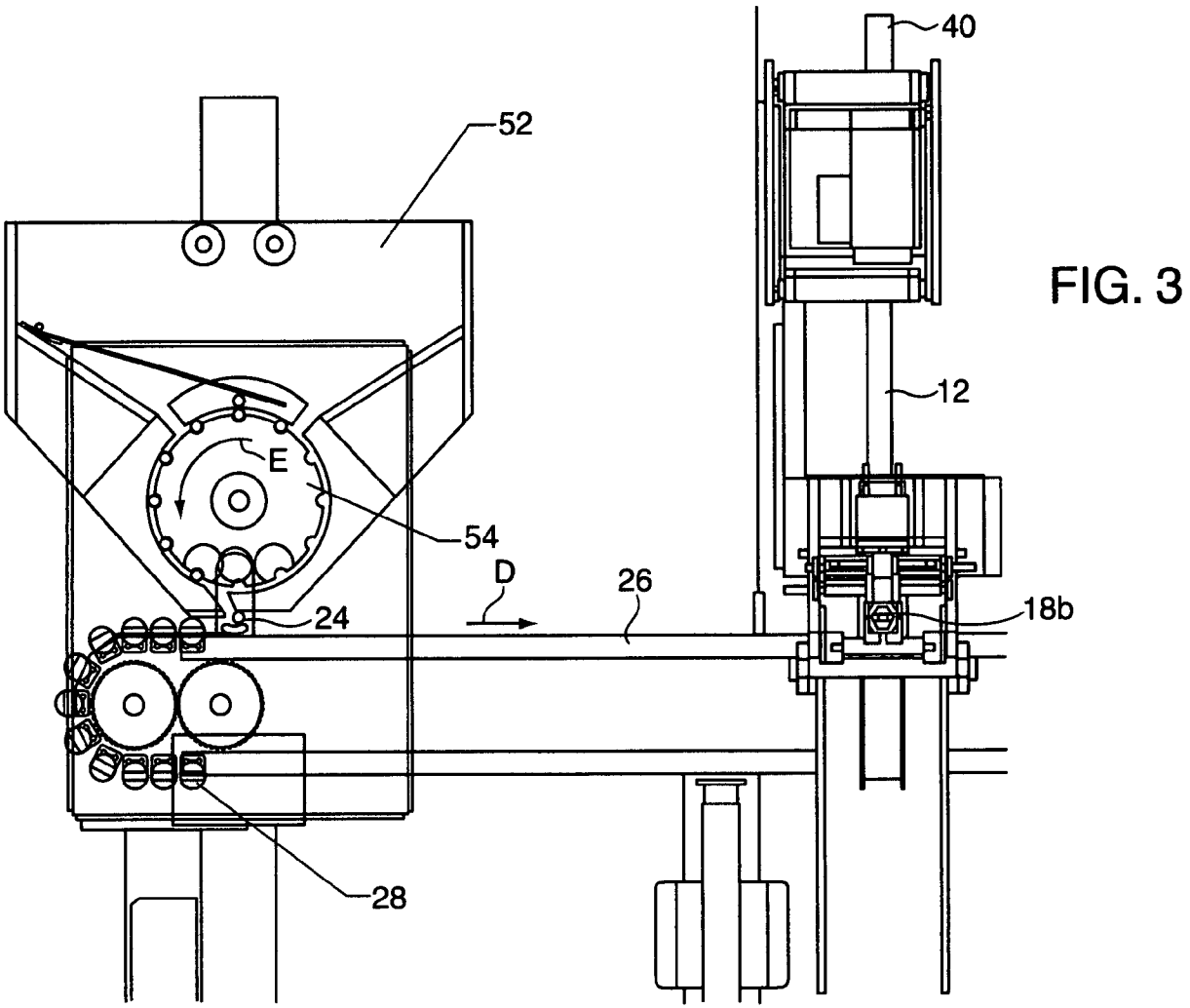
FIG. 3 is an end elevation view of the horizontal sleeve applicator of FIG. 2, including the product-supplying conveyor apparatus.

In the depiction of the present invention of FIGS. 2 and 3, and also shown in the second position of forming tube 18*b* (shown in FIG. 1), a mounting clamp 20 is provided to securely mount forming tube 18*b*, while allowing rapid changing to another size forming tube 18 by releasing a clamp mechanism, as is known. Mounting clamp 20 is omitted from the depiction of the first position of forming tube 18*a*, shown in dashed lines in FIG. 1 for reasons of clarity. Mounting clamp 20 is affixed to a driver 36 so as to be moved in the direction indicated by arrows B, B'.

Referring further to FIG. 1, with forming tube 18*b* in its second position in alignment with product 24, upon detection of the proximity of product 24 by a sensor (not shown), a driver 30 thrusts a ram 32 forward in the direction indicated by arrow C to discharge sleeve 22 from forming tube 18*b* onto product 24. Driver 30 and ram 32 rapidly retract after discharging sleeve 22 from forming tube 18*b*. A stop 34 is provided behind the rear end of product 24 in order to prevent product 24 from being moved backwards as sleeve 22 is assembled thereto. The diameter D of sleeve 22 is greater than the diameter d of product 24 by an amount sufficient to allow ease of assembly. In the preferred embodiment, conveyor 26 moves continuously and does not hesitate during the discharge of sleeve 22 onto product 24, which is accomplished by a quick thrust-and-retract movement of driver 30 and ram 32.

The processing of plastic resins through extrusion dies to form tubular film 12 typically results in a small variation of tubing diameter from one production run to another. In the case of known vertical assembly sleeve applicators, means are needed to ensure that the cut sleeve does not fall out of the vertical holder, whether a forming tube or another structure. This means for securing the cut sleeve can be accomplished by the holder bore being substantially equal to the diameter of the sleeve exterior to fit snugly together, thus requiring a change in holder size for virtually every production run of tubular material. Another known means to accommodate sleeve diameter variations in vertical applications is to provide a securement means, for example a suction nozzle as described in U.S. Pat. No. 4,914,893 to Strub, to attach temporarily to the sleeve side. As will be understood, an advantage of maintaining forming tube 18 of the present invention in horizontal orientation is that small variations in sleeve diameter are tolerated without the need to secure the sleeve from prematurely falling out of the holder.

Referring now to FIG. 2, a supply 40 of tubular film 12 is illustrated as being rotatably mounted at the right extremity of horizontal sleeve applicator 10 as tubular film 12 is drawn by drive rollers 46 in the direction indicated by arrow A. A tube spreader 42 is positioned within tubular film 12 upstream of drive rollers 46. As tubular film 12 is moved over spreader 42, tubular film 12 is spread to begin the opening process, which is completed within forming tube 18. Drive rollers 46 pull tubular film 12 from supply 40 and over spreader 42 and then push the downstream length of tubular film 12 between idler rollers 48, through cutter 14 and into forming tube 18*a*. Idler rollers 48 are used as an alignment guide for tubular film 12 and can be replaced by another style of guide. The overall length of sleeve 22 may be less than or greater than the length of forming tube 18*b*. Preferably, sleeve 22 is longer than forming tube 18 so that a short length of sleeve 22 extends out of the discharge end of forming tube 18 to reside as close as practical to product 24 (see FIG. 1), optimizing assembly accuracy.

As described in general above, drive rollers 46 move tubular film 12 forward into forming tube 18*a* in its first position, and cutter 14 severs the selected length off within forming tube 18*a*. Forming tube 18*a* then moves downwardly to its second position at 18*b* where ram 32, driven by driver 30, discharges cut sleeve 22 onto product 24 (see FIG. 1). As seen in FIG. 2, forming tube 18*a* is moved in the direction indicated by arrow B by driver 36 to the second position of forming tube 18*b*. Driver 30 and driver 36 are, for example, pneumatic cylinders as are generally available, or another type of linear actuator. In a variation of the present invention (not shown), a plurality of forming tubes 18 may be mounted on a rotatable plate such that in the first position, a first forming tube 18 receives a sleeve 22 while another sleeve 22 is discharged from a second forming tube 18 in the second position onto product 24. The plate then is rotated to place the first forming tube 18 in position to receive a further sleeve 22 and the second forming tube 18 to discharge an inserted sleeve 22 onto a subsequent product 24.

Referring now to FIG. 3, details of the supply of product 24 into horizontal sleeve applicator 10 are illustrated. The machine sections and actions that are described above in reference to FIGS. 1 and 2 are incorporated generally in the right portion of FIG. 3, including supply 40, tubular film 12 and forming tube 18*b*. In the left portion of FIG. 3, an open-top hopper 52 is mounted to receive a quantity of product 24 in horizontal orientation, but not linearly dispersed. Hopper 52 includes rotating gate 54 for linearly dispersing individual ones of product 24 sequentially onto conveyor 26, nested between adjacent support links 28. Conveyor 26 is driven in the direction indicated by arrow D by a motor or other means (not shown) to position product 24 in alignment with forming tube 18*b* and sleeve 22. Next, conveyor 26 continues to carry sleeve-enwrapped product 24 in the direction of arrow D to have sleeve 22 shrunk, by heat or other means, so as to snugly fit to product 24.

Figure 4B:
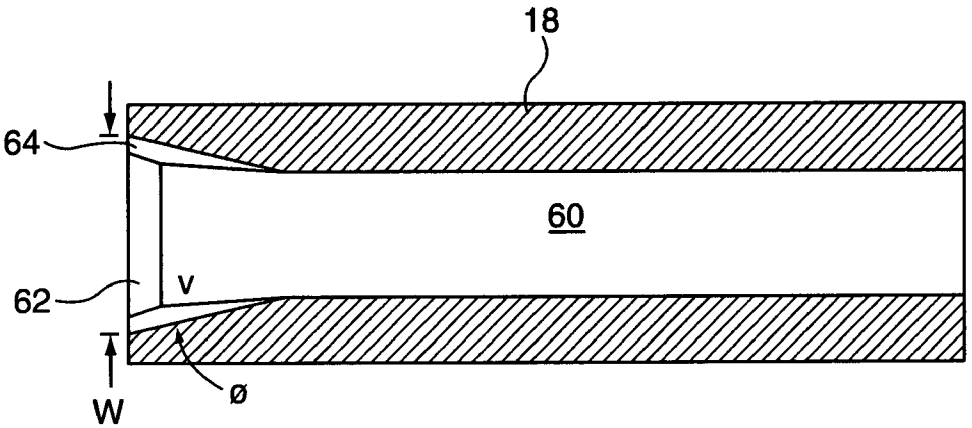
FIG. 4B is a cross sectional view of the forming tube taken in the direction of line 4B—4B of FIG. 4A.
Figure 4A:
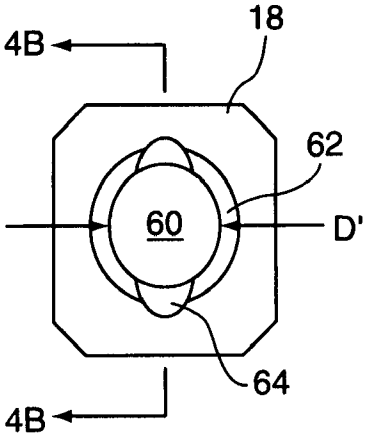
FIG. 4A is an entry-end elevation view of a forming tube used in the present invention.

Details of forming tube 18 are shown in FIGS. 4A and 4B, the latter view being a cross section view through the center of the former view. FIG. 4A shows the entry end of forming tube 18 in elevation view. It should be understood that the outside shape of forming tube 18 is a design choice, and not considered of significance to the invention. Forming tube 18 has a bore 60 extending longitudinally therethrough. The diameter D' of bore 60 is equal to or slightly greater than a maximum outside diameter D of sleeve 22 (see FIG. 1), so that a maximum size sleeve 22 will fit slidingly within bore 60, and a sleeve 22 with a smaller diameter will rest loosely therewithin. It is further understood that forming tube 18 has an internal channel with a cross sectional shape comparable to the cross sectional shape of the product to be enwrapped. In the case described herein, product 24 (FIG. 1) is round in cross section, whereas forming tube 18 has a circular bore; in a case where product 24 is of another cross sectional shape, e.g. square, the bore of forming tube 18 will be similarly shaped. A chamfer 62 is formed at the entry end of bore 60 to ensure that each entering sleeve 22 is moved into the center of bore 60. A pair of guide grooves 64 are formed at approximately 180° displacement from one another. Guide grooves 64, as shown clearly in cross section in FIG. 4B, are oriented at an angle $\phi$ to bore 60. The selection of angle $\phi$ is largely empirical according to the characteristics of tubular film 12 and forming tube 18. In the preferred embodiment of the invention, forming tube 18 is made of Delrin® plastic resin.

Whereas tubular film 12, as shown in FIG. 2, is in rolled form on supply 40, tubular film 12, and subsequently cut sleeve 22, will have residual creases at both edges thereof. By opening tubular film 12 over spreader 42, the creases are forced open, but are not eliminated. The width W of the entry end of guide grooves 64 is sufficient to receive the residual edge creases of sleeve 22. Preferably, width W is equal to the lay flat width of tubular film 12, i.e. the distance between edge creases when the tubing is flat. Guide grooves 64 taper toward bore 60 to force sleeve 22 from its creased, substantially elliptical cross sectional shape to a substantially round shape in forming tube 18 to smoothly enwrap the round cross section of product 24.

Figure 5:
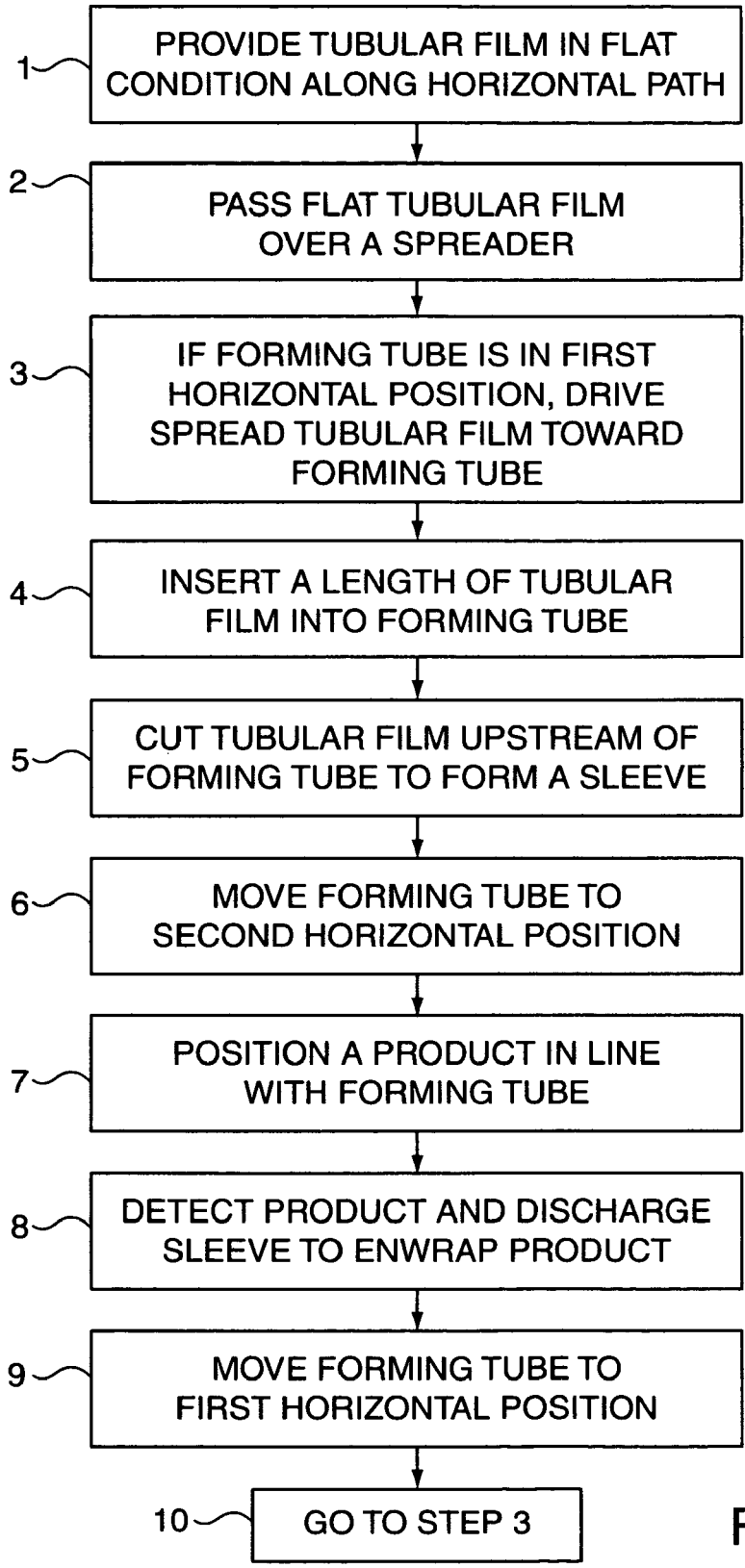
FIG. 5 is a process chart showing the steps in the process of the present invention.

Referring now to FIG. 5 in which the method steps for practicing the present invention are delineated, a supply 40 of flat tubular film 12 is provided in step 1. In step 2, the flat tubular film 12 is caused to be opened by passing over a spreader 42. When forming tube 18 is in its upper position, flat tubular film 12 is driven by drive rollers 46 for a selected distance toward forming tube 18 in step 3 to insert a selected length of tubular film 12 into forming tube 18*a* in step 4. In step 5, tubular film 12 is cut by cutter 14 at the selected length to form sleeve 22. In step 6, forming tube 18 is moved from its upper position to its lower position to be aligned with a height of a product 24. Product 24 is positioned in axial alignment with forming tube 18 in step 7, and sleeve 22 is discharged from forming tube 18 to enwrap product 24 in step 8. In step 9, forming tube 18 is returned to its upper position, and the process is reset to step 3 in step 10 to repeat the cycle.

While the description above discloses a preferred embodiment of the present invention, it is contemplated that numerous variations and modifications of the invention are possible and are considered to be within the scope of the claims that follow.

What is claimed is:

1. A horizontal sleeve applicator comprising:

a. a supply of a tubular film in flattened condition;

b. means located downstream of the tubular film supply for driving the tubular film in a downstream direction;

c. means for opening the flat tubular film located downstream of the means for driving the tubular film and mounted for moving between a first position in alignment with the tubular film from the supply and a second position, the second position being offset from the first position in a direction perpendicular to the downstream direction of the tubular film;

d. cutting means located between the means for driving and the means for opening, the cutting means adapted for severing the tubular film at a selected length to form a sleeve;

e. a driver for moving the means for opening between the first and second positions;

f. a conveyor for sequentially positioning each one of a series of horizontally oriented products in alignment with the second position of the means for opening; and g. means for discharging the sleeve from the means for opening so as to enwrap the aligned one of the series of horizontally oriented products.

2. The horizontal sleeve applicator as described in claim 1, wherein the means for opening the tubular film comprises a forming tube.

3. The horizontal sleeve applicator as described in claim 2, wherein the forming tube is formed with a substantially round bore having a plurality of guide grooves formed therein.

4. The horizontal sleeve applicator as described in claim 3, wherein the guide grooves are each oriented at an angle to the bore and originate from a position radially beyond the bore to blend into the bore.

5. The horizontal sleeve applicator as described in claim 3, wherein the forming tube has two diametrically opposed guide grooves.

6. The horizontal sleeve applicator as described in claim 3, wherein the guide grooves are round in cross section.

7. The horizontal sleeve applicator as described in claim 2, wherein the forming tube is formed with an internal shape that is not round and having a plurality of guide grooves formed therein.

8. The horizontal sleeve applicator as described in claim 1, wherein the means for driving the tubular film is adapted for intermittent driving.

9. The horizontal sleeve applicator as described in claim 1, wherein the means for discharging the sleeve comprises a linear actuator.

10. The horizontal sleeve applicator as described in claim 1, further comprising a tubular spreader disposed within the tubular film and located upstream of the means for driving the tubular film.

11. The horizontal sleeve applicator as described in claim 1 further comprising a sensor for detecting the proximity of a product and able to transmit a signal in response thereto so as to actuate the means for discharging the sleeve.

12. A method for applying a tubular sleeve horizontally to enwrap a product, comprising the steps of:

a. providing a supply of a tubular film in flat condition;

b. opening the flat tubular film;

c. driving the tubular film along a line in a downstream direction from the supply;

d. severing the tubular film so as to form a sleeve of selected length in a first position in alignment with the line along which the tubular film is driven from the supply;

e. moving the sleeve to a second position that is parallel to and offset from the line;

f. positioning a product in axial alignment with the sleeve in the second position; and g. moving the sleeve linearly to enwrap the product.

13. The method of claim 12, wherein the step of opening the flat tubular film comprises passing the tubular film around a spreader positioned upstream of the driver and driving the tubular film over the spreader.

14. The method of claim 13, wherein the step of opening the tubular film further comprises the step of inserting the tubular film into a forming tube having a bore and plural guide grooves formed therein, the forming tube residing downstream of the driver.

15. The method of claim 14, wherein the step of moving the sleeve to a second position comprises moving the forming tube with the sleeve positioned therewithin to the second position.

16. The method of claim 14, wherein the step of moving the sleeve to enwrap the product comprises extending an actuator in alignment with the second position of the forming tube to move the sleeve out of the forming tube and onto the product.

17. The method of claim 12, further comprising the step of sensing the presence of a product at a determined position and transmitting a signal in response thereto to cause the sleeve to move and enwrap the product.

18. A horizontal sleeve applicator comprising:

a. a supply of a tubular film in flattened condition;

b. means located downstream of the tubular film supply for driving the tubular film in a downstream direction along a path;

c. a forming tube having a plurality of internal guide grooves and being located downstream of the means for driving the tubular film, the forming tube mounted for moving between a first position in alignment with the tubular film from the supply and a second position, the second position being offset from the first position in a direction perpendicular to the path;

d. cutting means located between the means for driving and the forming tube, the cutting means adapted for severing a selected length of tubular film to form a sleeve;

e. a driver for moving the forming tube between the first and second positions;

f. a conveyor for sequentially positioning each one of a series of horizontally oriented products in alignment with the second position of the forming tube; and g. means for discharging the sleeve from the forming tube so as to enwrap the aligned one of the series of horizontally oriented products.

19. The horizontal sleeve applicator as described in claim 18, wherein the forming tube is formed with a substantially round bore.

20. The horizontal sleeve applicator as described in claim 18, wherein the guide grooves are each oriented at an angle to the bore and originate from a position radially beyond the bore to blend into the bore.

* * * * *